US011455963B2

(12) United States Patent
Yu et al.

(10) Patent No.: US 11,455,963 B2
(45) Date of Patent: Sep. 27, 2022

(54) DRIVING METHOD AND DRIVING CIRCUIT FOR BACKLIGHT, BACKLIGHT AND DISPLAY APPARATUS

(71) Applicants: BEIJING BOE DISPLAY TECHNOLOGY CO., LTD., Beijing (CN); BOE TECHNOLOGY GROUP CO., LTD., Beijing (CN)

(72) Inventors: Shuhuan Yu, Beijing (CN); Luqiang Guo, Beijing (CN)

(73) Assignees: BEIJING BOE DISPLAY TECHNOLOGY CO., LTD., Beijing (CN); BEIJING BOE TECHNOLOGY DEVELOPMENT CO., LTD., Beijing (CN)

( * ) Notice: Subject to any disclaimer, the term of this patent is extended or adjusted under 35 U.S.C. 154(b) by 846 days.

(21) Appl. No.: 16/320,707

(22) PCT Filed: Apr. 24, 2018

(86) PCT No.: PCT/CN2018/084225
§ 371 (c)(1),
(2) Date: Jan. 25, 2019

(87) PCT Pub. No.: WO2019/033780
PCT Pub. Date: Feb. 21, 2019

(65) Prior Publication Data

US 2021/0358422 A1 Nov. 18, 2021

(30) Foreign Application Priority Data

Aug. 14, 2017 (CN) ..... 201710690587.7

(51) Int. Cl.
*G09G 3/34* (2006.01)
*G09G 5/10* (2006.01)

(52) U.S. Cl.
CPC ..... *G09G 3/342* (2013.01); *G09G 5/10* (2013.01); *G09G 2320/0686* (2013.01); *G09G 2360/16* (2013.01)

(58) Field of Classification Search
None
See application file for complete search history.

(56) References Cited

U.S. PATENT DOCUMENTS 9,418,599 B2 8/2016 Yang
2006/0279522 A1 12/2006 Kurihara
(Continued)

FOREIGN PATENT DOCUMENTS

CN 101127198 A 2/2008
CN 101281732 A 10/2008
(Continued)

OTHER PUBLICATIONS

First Office Action dated Nov. 29, 2019, for corresponding Chinese application 201710690587.7.
(Continued)

*Primary Examiner* — Amr A Awad
*Assistant Examiner* — Donna V Bocar
(74) *Attorney, Agent, or Firm* — Nath, Goldberg & Meyer; Joshua B. Goldberg

(57) ABSTRACT

A driving method for a backlight is provided. The backlight includes a plurality of light-emitting elements, and the driving method includes steps of calculating a brightness difference value of an image to be displayed; and determining whether the brightness difference value of the image to be displayed is greater than a predetermined difference value of the image. When the brightness difference value of the image to be displayed is determined to be greater than the predetermined difference value of the image, the method includes steps of dividing the image to be displayed into a
(Continued)

plurality of sub-regions; partitioning the backlight according to brightness difference values of the plurality of sub-regions to obtain a plurality of final light-emitting regions of the backlight; and driving the backlight to emit light according to the plurality of final light-emitting regions. The present disclosure further provides a driving circuit, a backlight and a display device.

9 Claims, 3 Drawing Sheets

(56) References Cited

U.S. PATENT DOCUMENTS

| | | | | |
|---|---|---|---|---|
| 2009/0073109 | A1* | 3/2009 | Shin | G09G 3/3426 345/102 |
| 2009/0115718 | A1* | 5/2009 | Qiao | G09G 3/3611 345/102 |
| 2009/0140975 | A1 | 6/2009 | Nonaka et al. | |
| 2013/0314641 | A1* | 11/2013 | Okuda | G02F 1/1336 349/61 |

FOREIGN PATENT DOCUMENTS

| | | | |
|---|---|---|---|
| CN | 101325043 | A | 12/2008 |
| CN | 101414437 | A | 4/2009 |

OTHER PUBLICATIONS

International Search Report dated Jul. 30, 2018 corresponding to application No. PCT/CN2018/084225.

* cited by examiner

DRIVING METHOD AND DRIVING CIRCUIT FOR BACKLIGHT, BACKLIGHT AND DISPLAY APPARATUS

CROSS-REFERENCE TO RELATED APPLICATIONS

This is a National Phase Application filed under 35 U.S.C. 371 as a national stage of PCT/CN2018/084225, filed Apr. 24, 2018, an application claiming the benefit of Chinese Application No. 201710690587.7, filed Aug. 14, 2017, the content of each of which is hereby incorporated by reference in its entirety.

TECHNICAL FIELD

The present disclosure relates to the field of display apparatus, in particular, to a driving method for a backlight, a driving circuit for a backlight, a backlight and a display apparatus including the driving circuit.

BACKGROUND

In a display device requiring a backlight, in order to enhance a display effect for displaying an image, the backlight is usually controlled on a partition-by-partition basis, i.e., controlled by local dimming. Usually, the partitions of the backlight are fixed. When displaying an image with a small overall brightness difference, a separate control of each partition of the backlight will increase power consumption. For an image with a large different brightness between pixel units, the backlight controlled by local dimming sometimes may not meet the display requirements.

SUMMARY

The present disclosure provides a driving method for a backlight, a driving circuit for a backlight, a backlight and a display apparatus including the driving circuit.

As a first aspect of the present disclosure, a driving method for a backlight is provided to drive the backlight to emit light according to an image to be displayed, and includes steps of: calculating a brightness difference value of the image to be displayed, such that the brightness difference value of the image to be displayed indicates a difference among brightness of all parts of the image to be displayed; determining whether the brightness difference value of the image to be displayed is greater than a predetermined difference value of the image; and when the brightness difference value of the image to be displayed is greater than the predetermined difference value of the image: dividing the image to be displayed into a plurality of sub-regions; partitioning the backlight according to brightness difference values of the plurality of sub-regions to obtain a plurality of final light-emitting regions of the backlight, such that each of the plurality of sub-regions corresponds to at least one of the plurality of final light-emitting regions, and the number of final light-emitting regions corresponding to each of the plurality of sub-regions is positively correlated with the brightness difference value of the sub-region, and the brightness difference value of the sub-region indicates a difference among brightness of a plurality of parts of the sub-region; and driving the backlight to emit light according to the plurality of final light-emitting regions.

Optionally, the backlight includes a plurality of initial light-emitting regions, and the step of dividing the image to be displayed into a plurality of sub-regions includes a step of: dividing the image to be displayed into the plurality of sub-regions such that the plurality of sub-regions are in one-to-one correspondence with the plurality of initial light-emitting regions.

Optionally, the driving method further includes a step of driving the backlight to emit light according to the plurality of initial light-emitting regions when it is determined that the brightness difference value of the image to be displayed is not greater than the predetermined difference value of the image.

Optionally, the step of partitioning the backlight according to brightness difference values of the plurality of sub-regions includes a step of: dividing an initial light-emitting region corresponding to a sub-region into a plurality of final light-emitting regions when a brightness difference value of the sub-region exceeds a first predetermined difference value.

Optionally, the step of partitioning the backlight according to brightness difference values of the plurality of sub-regions includes a step of: merging initial light-emitting regions corresponding to two adjacent sub-regions to obtain a final light-emitting region when a brightness difference between the two adjacent sub-regions is less than a second predetermined difference value and the brightness difference value of each of the two adjacent sub-regions is less than the second predetermined difference value, wherein the brightness difference between the two adjacent sub-regions indicates a difference between brightness of the two adjacent sub-regions, and the first predetermined difference value is larger than the second predetermined difference value.

Optionally, the step of calculating a brightness difference value of the image to be displayed includes a step of: calculating the brightness difference value of the image to be displayed according to an average brightness value of the image to be displayed, and differences between respective brightness values of all pixel units of the image to be displayed and the average brightness value, and the step of partitioning the backlight according to the brightness difference values of the plurality of sub-regions includes steps of: calculating the brightness difference value of each sub-region of the plurality of sub-regions according to the average brightness value of the sub-region and the differences between respective brightness values of all pixel units of the sub-region and the average brightness value of the sub-region, and partitioning the backlight according to the respective brightness difference values of the plurality of sub-regions.

Optionally, the image to be displayed is divided into a plurality of sub-images, and the step of calculating a brightness difference value of the image to be displayed includes a step of: calculating the brightness difference value of the image to be displayed according to a plurality of average brightness values of the plurality of sub-images of the image to be displayed, and a largest average brightness value and a smallest average brightness value among the plurality of average brightness values, and each sub-region of the plurality of sub-regions is divided into a plurality of regional sub-images, and the step of partitioning the backlight according to brightness difference values of the plurality of sub-regions includes steps of: calculating the brightness difference value of the sub-region according to a plurality of average brightness values of the plurality of regional sub-images of the sub-region, and a largest average brightness value and a smallest average brightness value among the plurality of average brightness values, and partitioning the backlight according to the respective brightness difference values of the plurality of sub-regions.

As a second aspect of the present disclosure, a driving circuit of a backlight is provided to include a brightness difference calculation sub-circuit, which is configured to calculate a brightness difference value of an image to be displayed, and the brightness difference value of the image to be displayed represents a brightness difference among all parts of the image to be displayed; a comparison sub-circuit, which is configured to compare the brightness difference value of the image to be displayed with a predetermined difference value of the image to generate a comparison result; an image partition sub-circuit, which is configured to divide the image to be displayed into a plurality of sub-regions when the brightness difference value of the image to be displayed is greater than the predetermined difference value of the image, a backlight partition sub-circuit, which is configured to partition the backlight according to the brightness difference values of the plurality of sub-regions to obtain a plurality of final light-emitting regions, such that the number of the plurality of final light-emitting regions corresponding to each sub-region is positively correlated to the brightness difference value of the sub-region; and a driving sub-circuit, which is configured to generate a partition control signal according to positions of the plurality of final light-emitting regions generated by the backlight partition sub-circuit and send the partition control signal to the backlight to drive the backlight to emit light according to the plurality of final light-emitting regions.

Optionally, the backlight includes a plurality of initial light-emitting regions, and the plurality of sub-regions of the image to be displayed are in one-to-one correspondence with the plurality of initial light-emitting regions.

Optionally, the driving sub-circuit is further configured to drive the backlight to emit light according to the plurality of initial light-emitting regions when the brightness difference value of the image to be displayed is not greater than the predetermined difference value of the image.

Optionally, the backlight partition sub-circuit is further configured to divide the initial light-emitting region corresponding to a sub-region of the plurality of sub-regions into a plurality of final light-emitting regions when the brightness difference value of the sub-region exceeds a first predetermined difference value.

Optionally, the backlight partition sub-circuit is further configured to merge two initial light-emitting regions of the backlight corresponding to two adjacent sub-regions to obtain a final light-emitting region when a brightness difference between the two adjacent sub-regions is smaller than a second predetermined difference value, and the first predetermined difference value is larger than the second predetermined difference value.

As a third aspect of the present disclosure, a backlight is provided to include a plurality of light-emitting elements and a control signal receiving terminal which is electrically coupled to the above driving sub-circuit of the driving circuit provided by the present disclosure, and the plurality of light-emitting elements of the backlight form a plurality of final light-emitting regions according to the partition control signal.

Optionally, the backlight is divided into a plurality of initial light-emitting regions and includes a plurality of input terminals and a plurality of first switching circuits, and the partition control signal includes a first switching control signal and a second switching control signal; each initial light-emitting region of the plurality of initial light-emitting regions includes two or more light-emitting elements of the plurality of light-emitting elements, and corresponds to an input terminal of the plurality of input terminals, which supplies power to the two or more light-emitting elements in the initial light-emitting region, and a first switching circuit of the plurality of first switching circuits is provided between two adjacent initial light-emitting regions of the plurality of initial light-emitting regions; and the first switching circuit includes a control terminal electrically coupled to the control signal receiving terminal, and is configured to cause the two adjacent initial light-emitting regions to be connected in series when the first switching control signal is received by the control terminal of the first switching circuit, and cause the two adjacent initial light-emitting regions to be disconnected from each other when the second switching control signal is received by the control terminal of the first switching circuit.

Optionally, the backlight further includes a plurality of second switching circuits, and the partition control signal includes a third switching control signal and a fourth switching control signal; each of the initial light-emitting regions includes a plurality of light-emitting circuits, each of which includes at least one light-emitting element, and a second switching circuit of the plurality of second switching circuits is arranged between two adjacent light-emitting circuits in a same initial light-emitting region; and the second switching circuit includes a control terminal electrically coupled to the control signal receiving terminal, and the second switching circuit is configured to cause the two adjacent light-emitting circuits to be connected in series when the third switching control signal is received by the control terminal of the second switching circuit, and cause the two adjacent light-emitting circuits to be connected in parallel when the fourth switching control signal is received by the control terminal of the second switching circuit.

Optionally, the first switching circuit includes a first switching sub-circuit and a second switching sub-circuit; the first switching sub-circuit is connected in series between two adjacent input terminals of the plurality of input terminals; and the second switching sub-circuit is arranged between two adjacent initial light-emitting regions of the plurality of initial light-emitting regions, and a control terminal of the second switching sub-circuit is electrically coupled to the control terminal of the first switching sub-circuit; when the first switching control signal is received by the control terminal of the second switching sub-circuit, the second switching sub-circuit controls the first switching sub-circuit to be turned on and controls two initial light-emitting regions located at opposite sides of the second switching sub-circuit to be connected in series, and when the second switching control signal is received by the control terminal of the second switching sub-circuit, the second switching sub-circuit controls the first switching sub-circuit to be turned off and controls the two initial light-emitting regions located at the opposite sides of the second switching sub-circuit to be electrically coupled to the corresponding input terminals, respectively.

Optionally, the backlight further includes a power supply circuit, which includes a plurality of output circuits, a plurality of output terminals of the plurality of output circuits are electrically coupled to the plurality of input terminals, respectively, each output circuit of the plurality of output circuits includes a driving chip, a first reference voltage input terminal, a second reference voltage input terminal, a DC power feedback terminal, a driving sub-circuit feedback terminal, a first resistor, a second resistor, a third resistor and a fourth resistor, a first terminal of the first resistor is electrically coupled to the output terminal, and a second terminal of the first resistor is electrically coupled to the first reference voltage input terminal; a first terminal of the second resistor is electrically coupled to the second terminal of the first resistor, and a second terminal of the second resistor is electrically coupled to the DC power feedback terminal; a first terminal of the third resistor is electrically coupled to the second terminal of the second resistor, and a second terminal of the third resistor is electrically coupled to the second reference voltage input terminal; a first terminal of the fourth resistor is electrically coupled to the second terminal of the first resistor, and a second terminal of the fourth resistor is electrically coupled to the driving sub-circuit feedback terminal; and the driving chip outputs a corresponding feedback voltage to the driving sub-circuit feedback terminal based on a received feedback control signal.

As a fourth aspect of the present disclosure, a display device is provided to include a display panel, a backlight and a driving circuit for driving the backlight, and the backlight includes a plurality of light-emitting elements, and the driving circuit is the above driving circuit provided by the present disclosure.

Optionally, the backlight is the above backlight provided by the present disclosure.

BRIEF DESCRIPTION OF THE DRAWINGS

The accompanying drawings are intended to provide a further understanding of the present disclosure and constitute a part of the description for explaining the present disclosure in conjunction with the following specific embodiments, but do not limit the present disclosure. In the drawings.

DETAILED DESCRIPTION

Specific embodiments of the present disclosure will be described in detail below in conjunction with the accompanying drawings. It should be understood that, the specific embodiments described herein are only for illustrating and interpreting the present disclosure and are not intended to limit the present disclosure.

In the existing technology for partition control of a backlight, the partitions of the backlight are fixed, which makes it impossible to meet the display requirements while reducing the power consumption of the backlight. To this end, the present disclosure particularly provides a method for driving a backlight, a driving circuit of a backlight, a backlight and a display apparatus including the driving circuit. When the method for driving the backlight is used to drive the backlight, the backlight partition may be adjusted based on the image to be displayed.

In the description, the term "brightness" may refer to a bright degree expressed by a gray scale in the display field. Typically, gray scale values include 256 values of integers from 0 to 255. For example, brightness 50 may refer to a gray scale 50. That is, brightness 50 refers to a case where the gray scale value is 49.

Figure 1:
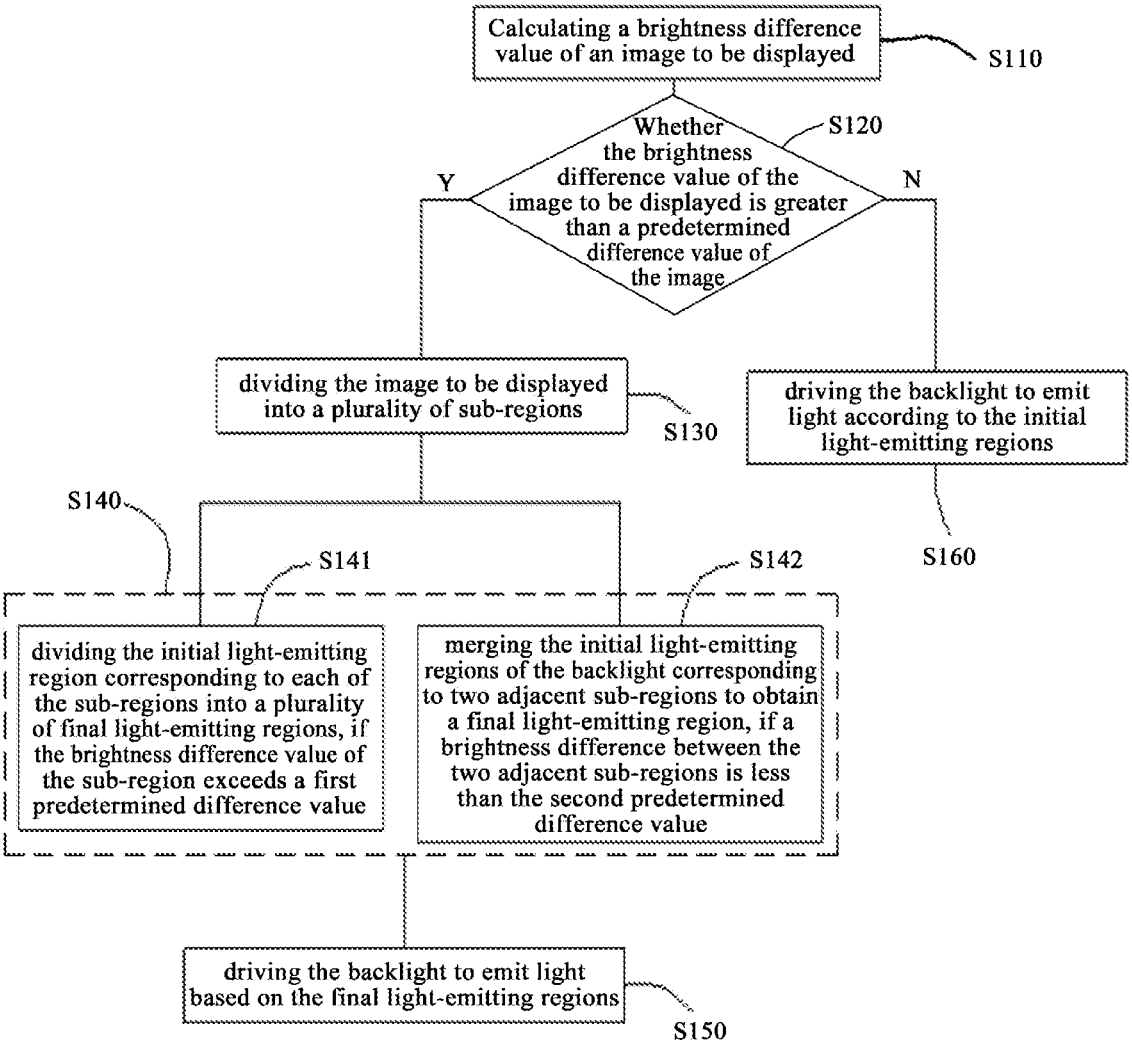
FIG. 1 is a flowchart showing a method for driving a backlight provided by the present disclosure.

As an aspect of the present disclosure, a method for driving a backlight is provided, and the backlight includes a plurality of light-emitting elements. As shown in FIG. 1, the method includes steps S110 to S150.

At the step S110, a brightness difference value of an image to be displayed is calculated, and the brightness difference value of the image to be displayed represents a brightness difference among all parts of the image to be displayed.

At the step S120, whether the brightness difference value of the image to be displayed is greater than a predetermined difference value of the image or not is determined.

When the brightness difference value of the image to be displayed is determined to be greater than the predetermined difference value of the image in the step S120, the steps S130 to S150 are performed.

At the step S130, the image to be displayed is divided into a plurality of sub-regions.

At the step S140, the backlight is partitioned based on brightness difference values of the plurality of sub-regions to obtain a plurality of final light-emitting regions of the backlight, such that each of the plurality of sub-regions corresponds to at least one of the plurality of final light-emitting regions, there is a positive correlation between the number of the final light-emitting regions corresponding to each sub-region and the brightness difference value of the sub-region, and the brightness difference value of the sub-region represents the brightness difference among all parts of the sub-region.

At the step S150, the backlight is driven to emit light based on the final light-emitting regions.

It should be pointed out that, the plurality of sub-regions of the image to be displayed have fixed sizes and fixed positions.

It should be pointed out that, the so-called "positive correlation" in the step S140 means that the number of the final light-emitting regions increases with the increase of the brightness difference value of the sub-region. When the brightness difference value of a sub-region is large, the number of the final light-emitting regions of the backlight corresponding to the sub-region is also large; when the brightness difference value of a sub-region is small, the number of the final light-emitting regions of the backlight corresponding to the sub-region is also small.

When the method for driving the backlight is used to drive the backlight to emit light, positions and areas of the final light-emitting regions of the backlight are no longer fixed, but are changed according to the brightness difference value of the image to be displayed. The larger the brightness difference value of each of the sub-regions of the image to be displayed, the more the number of the final light-emitting regions corresponding to the sub-region, which is advantageous to improve the display effect of the sub-region. The smaller the brightness difference value of each of the sub-regions of the image to be displayed, the less the number of the final light-emitting regions corresponding to the sub-region, thereby reducing the energy consumption for displaying the sub-region.

In the present disclosure, the brightness difference value A of the image to be displayed may be calculated based on the following method including steps S1 to S4.

At the step S1, an average brightness value La of the image to be displayed is calculated.

At the step S2, difference values ΔL between brightness values of all pixel units of the image to be displayed and the average brightness value La are calculated.

At the step S3, the number n of the pixel units of which ΔL>L0 is calculated, where L0 is a first predetermined brightness value.

At the step S4, the brightness difference value A of the image to be displayed is calculated according to the following formula (1):

$$A = \frac{n}{N} \times 100\% \quad (1)$$

Wherein, N is the total number of the pixel units of the image to be displayed.

In the present disclosure, L0 and the predetermined difference value of the image may be set based on the specific display requirements. For example, L0 may be set to be 50 and the predetermined difference value of the image may be set to be 25%.

Similarly, the brightness difference value of each sub-region may be calculated with the above method. For example, an average brightness value of the sub-region may be calculated, difference values between the brightness values of all pixel units of the sub-region and the average brightness value may be calculated, and the brightness difference value of the sub-region may be calculated with steps similar to the steps S3 and S4.

Of course, the present disclosure is not limited thereto, and a user may define an algorithm for the brightness difference value according to actual requirements.

For example, the brightness difference value A of the image to be displayed may also be calculated according to a following method including steps S1' to S3'.

At the step S1', the image to be displayed is divided into m sub-images.

At the step S2', average brightness values of the m sub-images are calculated, respectively.

At the step S3', the brightness difference value A of the image to be displayed is calculated according to the following formula (2):

$$A = L\max - L\min \quad (2)$$

Wherein, Lmax is the average brightness value of a sub-image with the largest average brightness value, and Lmin is the average brightness value of a sub-image with the smallest average brightness value, among all the sub-images.

Similarly, the brightness difference values of all the sub-regions may be calculated with the above method. For example, each sub-region may be divided into a plurality of sub-images, and the brightness difference value of each sub-region may be calculated with the steps S2' and S3'.

In this embodiment, the predetermined difference value of the image may be set to be 50.

When the method for driving the backlight is used to drive the backlight to emit light, the energy consumption of the backlight can be reduced while ensuring the display effect.

Optionally, the backlight may include a plurality of initial light-emitting regions. Thus, the plurality of sub-regions of the image to be displayed obtained in the step 130 may be are in one-to-one correspondence with the plurality of initial light-emitting regions.

Figure 2:
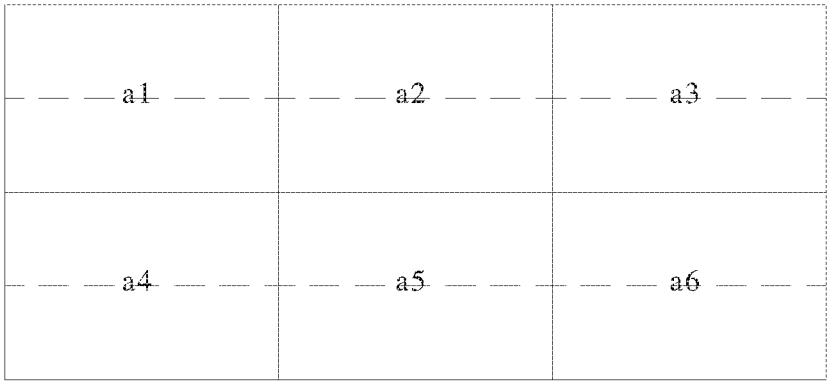
FIG. 2 is a schematic view illustrating partitions of a backlight provided by the present disclosure.
Figure 3:
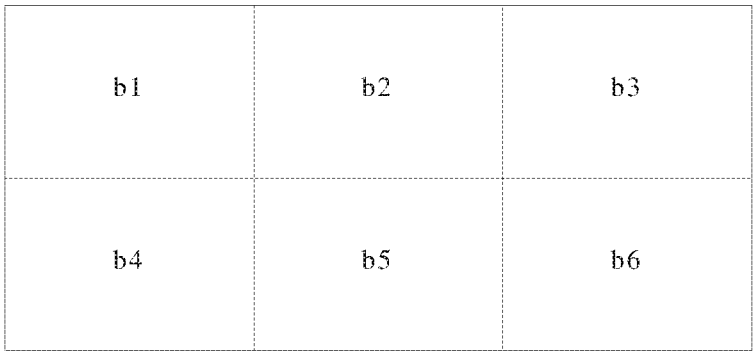
FIG. 3 is a schematic view illustrating partitions of an image to be displayed provided by the present disclosure.

For example, in the schematic view shown in FIG. 2, the backlight includes six initial light-emitting regions: an initial light-emitting region a1, an initial light-emitting region a2, an initial light-emitting region a3, an initial light-emitting region a4, an initial light-emitting region a5 and an initial light-emitting region a6. Accordingly, the image to be displayed is divided into six sub-regions. As shown in FIG. 3, the six sub-regions are a sub-region b1 corresponding to the initial light-emitting region a1, a sub-region b2 corresponding to the initial light-emitting region a2, a sub-region b3 corresponding to the initial light-emitting region a3, a sub-region b4 corresponding to the initial light-emitting region a4, a sub-region b5 corresponding to the initial light-emitting region a5, and a sub-region b6 corresponding to the initial light-emitting region a6.

For example, when the brightness difference value in the sub-region b1 is relatively large, the initial light-emitting region a1 corresponding to the sub-region b1 may be partitioned into two final light-emitting regions. When the brightness difference value in the sub-region b2 is relatively small, a further processing operation may not be performed on the initial light-emitting region a2, which acts as the final light-emitting region corresponding to the sub-region b2.

In the present disclosure, there is no limit on how to drive the backlight to emit light when the brightness difference value of the image to be displayed is not greater than the predetermined difference value of the image. As an optional embodiment of the present disclosure, the method for driving the backlight may also include a step S160.

When it is determined at the step 120 that the brightness difference value of the image to be displayed is not greater than the predetermined difference value of the image, the step S160 is performed, and at the step S160, the backlight is driven to emit light according to the initial light-emitting regions.

In other words, in the method for driving the backlight provided in the present disclosure, for a case where the backlight includes a plurality of initial light-emitting regions, when the brightness difference value of the image to be displayed is not greater than the predetermined difference value of the image, the light-emitting regions of the backlight are not further partitioned to maintain the plurality of initial light-emitting regions; when the brightness difference value of the image to be displayed is greater than the predetermined difference value of the image, the backlight is required to be partitioned again based on the brightness difference values of all the sub-regions of the image to be displayed.

In the present disclosure, there is no special limit on how to implement the step S140. In the case that the backlight includes a plurality of initial light-emitting regions, the step S140 optionally includes steps S141 and S142.

At the step S141, when the brightness difference value of each of the sub-regions exceeds a first predetermined difference value, the initial light-emitting region corresponding to the sub-region is divided into a plurality of final light-emitting regions.

In the present disclosure, the brightness difference value of each of the sub-regions may be calculated in the same manner as for calculating the brightness difference value of the image to be displayed. In particular, a method for calculating the brightness difference value A' of each of the sub-regions may include the following steps S11 to S41.

At the step S11, an average brightness value La of each of all pixel units in the sub-region is calculated.

At the step S21, a difference A L' between a brightness value of each of all the pixel units in the sub-region and the average brightness value is calculated.

At the step S31, the number m of the pixel units of which ΔL'>L0' is calculated, where L0' is a second predetermined brightness value.

At the step S41, the brightness difference value A' of the sub-region is calculated according to the following formula (3):

$$A' = \frac{m}{M} \times 100\% \tag{3}$$

Where, M is the total number of each of all the pixel units in the sub-region.

In the present disclosure, L0' and the first predetermined difference value may be set according to specific display requirements. For example, L0' may be set to be 50 and the first predetermined difference value may be set to be 25%.

In the present disclosure, the brightness difference value A' of each of the sub-regions may be calculated according to the following method including steps S11' to S31'.

At the step S11', each sub-region is divided into m secondary sub-images.

At the step S21', an average brightness value of each of the m secondary sub-images is calculated.

At the step S31', a brightness difference value A' of each sub-region is calculated according to the following formula (4):

$$A' = L'\max - L'\min \tag{4}$$

Where, L'max is an average brightness value of a secondary sub-image with the largest average brightness value, and L'min is an average brightness value of a secondary sub-image with the smallest average brightness value, among all the secondary sub-images.

In this embodiment, the first predetermined difference value may be set to be 50.

It can be seen that, the sub-region with the larger brightness difference value corresponds to more final light-emitting regions, and an area of each of the final light-emitting regions is smaller than an area of the initial light-emitting region corresponding to the sub-region, thus facilitating the fine display of the image.

For example, when the brightness difference value of the sub-region b1 exceeds the first predetermined difference value, the initial light-emitting region a1 may be divided into two final light-emitting regions (see the dashed line in FIG. 2).

When the brightness difference value of each sub-region is not greater than the first predetermined difference value, the initial light-emitting region corresponding to the sub-region may not be further partitioned.

In order to further reduce energy consumption, optionally, the step S140 may further include a step S142.

At the step S142, when a brightness difference between two adjacent sub-regions is less than the second predetermined difference value, and both the brightness difference values of the two adjacent sub-regions each are less than the second predetermined difference value, the initial light-emitting regions of the backlight corresponding to the two adjacent sub-regions are merged to obtain a final light-emitting region. The brightness difference between the two adjacent sub-regions represents a difference between the brightness of the two adjacent sub-regions, and the first predetermined difference value is larger than the second predetermined difference value.

In the context, a brightness difference between two adjacent sub-regions and the above brightness difference value of a sub-region are two different quantities. The brightness difference between two adjacent sub-regions indicates the difference between the brightness of the two adjacent sub-regions, and the brightness difference value of a sub-region indicates the difference among the brightness of different parts of the sub-region. The case that the brightness difference between two adjacent sub-regions less than the second predetermined difference value, means that the brightness difference between the two adjacent sub-regions is small. In some embodiments, the brightness difference between the two adjacent sub-regions may refer to the brightness difference value calculated by treating the two adjacent sub-regions as a whole "sub-region" and using the method of calculating the brightness difference value of the whole sub-region as described above (e.g., the steps S11 to S41, or steps S11' to S31'). Therefore, in the step S142, the initial light-emitting regions corresponding to the two adjacent sub-regions with a small brightness difference therebetween may be emerged to further reduce the energy consumption required to drive the backlight.

For example, when the brightness difference between two adjacent sub-regions is calculated, the two adjacent sub-regions may be regarded as a large region, and then the brightness difference between the two adjacent sub-regions may be calculated according to the formula (3) or the formula (4).

In the present disclosure, the second predetermined difference value may be set to 10% when the brightness difference value of each sub-region is calculated according to the formula (3), and the second predetermined difference value may be set to 20% when the brightness difference value of each sub-region is calculated according to the formula (4). Of course, this disclosure is not limited thereto.

Figure 4:
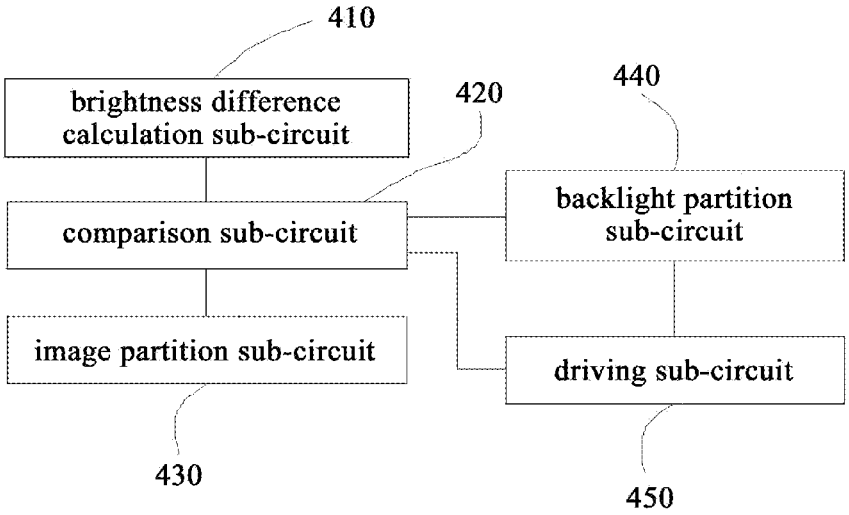
FIG. 4 is a block diagram of a structure of a driving circuit provided by the present disclosure.

As a second aspect of the disclosure, a driving circuit of a backlight is provided. The backlight includes a plurality of light-emitting elements. As shown in FIG. 4, the driving circuit includes a brightness difference calculation sub-circuit 410, a comparison sub-circuit 420, an image partition sub-circuit 430, a backlight partition sub-circuit 440 and a driving sub-circuit 450, which can perform the driving method of the backlight described above.

The brightness difference calculation sub-circuit 410 is configured to perform the step S110, that is, to calculate a brightness difference value of an image to be displayed.

The comparison sub-circuit 420 is configured to perform the step S120, that is, to compare the brightness difference value of the image to be displayed with a predetermined difference value of the image, and to generate a comparison result.

The image partition sub-circuit 430 is configured to perform the step S130, that is, to divide the image to be displayed into a plurality of sub-regions when the brightness difference value of the image to be displayed is greater than the predetermined difference value of the image.

The backlight partition sub-circuit 440 is configured to perform the step S140, that is, the backlight partition sub-circuit 440 is configured to partition the backlight according to the brightness difference values of the plurality of sub-regions to obtain a plurality of final light-emitting regions, such that each of the sub-regions corresponds to at least one of the plurality of final light-emitting regions, and the number of the final light-emitting regions corresponding to each sub-region is positively correlated to the brightness difference value of the sub-region.

The driving sub-circuit 450 is configured to perform the step S150, that is, the driving sub-circuit 450 is configured to generate a partition control signal according to positions of the final light-emitting regions generated by the backlight partition sub-circuit 440 and send the partition control signal to the backlight to drive the backlight to emit light according to the final light-emitting regions.

The driving circuit provided in the present disclosure is configured to perform the driving method described above. The advantages and working principles of the foregoing driving method have been described in detail, and will not be discussed here.

As described above, in some embodiments, the backlight may include a plurality of initial light-emitting regions, and the plurality of sub-regions of the image to be displayed are in one-to-one correspondence with the plurality initial light-emitting regions.

In the case that the backlight includes a plurality of initial light-emitting regions, the driving sub-circuit 450 may be further configured to perform the step S160, that is, the driving sub-circuit 450 is further configured to drive the backlight to emit light according to the initial light-emitting regions when the brightness difference value of the image to be displayed is not greater than the predetermined difference value of the image.

In the case that the backlight includes a plurality of initial light-emitting regions, optionally, the backlight partition sub-circuit 440 is further configured to implement the step S141. That is, the backlight partition sub-circuit 440 is configured to divide the initial light-emitting region corresponding to a sub-region into a plurality of final light-emitting regions when the brightness difference value of the sub-region exceeds the first predetermined difference value.

In the case that the backlight includes a plurality of initial light-emitting regions, optionally, the backlight partition sub-circuit 440 is further configured to implement the step S142. That is, the backlight partition sub-circuit 440 is further configured to, when the brightness difference between two adjacent sub-regions is less than the second predetermined difference value, and the brightness difference value of each of the two adjacent sub-regions is less than the second predetermined difference value, merge the initial light-emitting regions of the backlight corresponding to the two sub-regions to obtain a final light-emitting region, the first predetermined difference value being larger than the second predetermined difference value.

As a third aspect of the present disclosure, a backlight is provided to include a plurality of light-emitting elements, and the backlight further includes a control signal receiving terminal, which is electrically coupled to the driving sub-circuit of the driving circuit provided by the present disclosure. The plurality of light-emitting elements of the backlight may form the final light-emitting regions based on the partition control signal.

The plurality of light-emitting elements may be partitioned based on the partition control signal generated by the driving sub-circuit 450. Thus, partition of the backlight is no longer fixed, which can achieve better display effect and reduce energy consumption.

Figure 5:
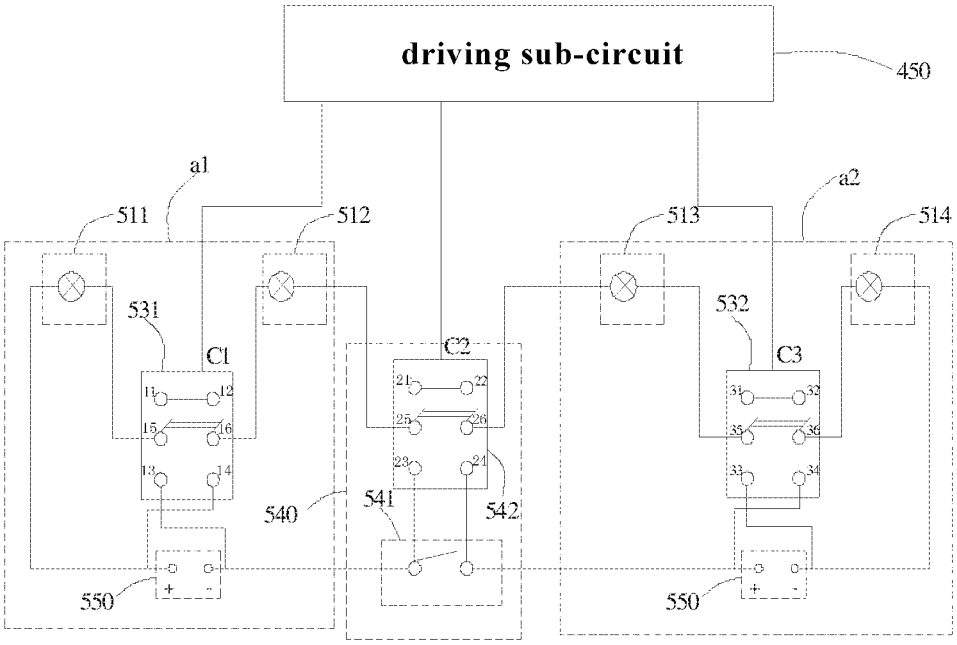
FIG. 5 is a circuit diagram of a backlight provided by the present disclosure.

As an optional embodiment of the present disclosure, as shown in FIG. 5, the backlight includes a plurality of initial light-emitting regions (e.g., the initial light-emitting regions a1 and a2 shown in FIG. 5), a plurality of input terminals 550 and a plurality of first switching circuits 540 (one of the first switching circuits 540 is shown in FIG. 5 as an example). Accordingly, the partition control signal may include a first switching control signal and a second switching control signal.

Each initial light-emitting region includes a plurality of light-emitting elements, and corresponds to an input terminal 550, which supplies power to the light-emitting elements in the initial light-emitting region. Furthermore, a first switching circuit 540 is arranged between two adjacent initial light-emitting regions.

The control signal receiving terminal includes a control terminal of the first switching circuit 540. When the control terminal of the first switching circuit 540 receives the first switching control signal, the first switching circuit 540 causes two adjacent initial light-emitting regions to be connected in series (for example, the light-emitting elements of the two adjacent initial light-emitting regions are connected in series). When the control terminal of the first switching circuit 540 receives the second switching control signal, the first switching circuit 540 causes the two adjacent initial light-emitting regions to be disconnected from each other.

As a specific implementation of the step S142, when the first switching circuit 540 is closed, the two adjacent initial light-emitting regions are merged. When the first switching circuit 540 is open, the two adjacent initial light-emitting regions are independent from each other.

In the present disclosure, there is no special limitation on the specific structure of the initial light-emitting region. For example, in the specific implementation shown in FIG. 5, each initial light-emitting region includes a plurality of light-emitting sub-circuits (FIG. 5 shows an initial light-emitting region a1 including a light-emitting sub-circuit 511 and a light-emitting sub-circuit 512, and an initial light-emitting region a2 including a light-emitting sub-circuit 513 and a light-emitting sub-circuit 514). Each light-emitting sub-circuit includes at least one light-emitting element, and a second switching circuit is arranged between two adjacent light-emitting sub-circuits located in the same initial light-emitting region. For example, in the embodiment shown in FIG. 5, a second switching circuit 531 is arranged between the light-emitting sub-circuit 511 and the light emitting sub-circuit 512, and a second switching circuit 532 is arranged between the light-emitting sub-circuit 513 and the light-emitting sub-circuit 514. Accordingly, the partition control signal includes a third switching control signal and a fourth switching control signal.

The control signal receiving terminal also includes a control terminal of the second switching circuit. When the control terminal of the second switching circuit receives a third switching control signal, two adjacent light-emitting sub-circuits located in the same initial light-emitting region are connected in series. When the control terminal of the second switch circuit receives a fourth switching control signal, two adjacent light-emitting sub-circuits located in the same initial light-emitting region are connected in parallel.

The step S141 in the driving method provided in the present disclosure can be implemented by supplying the third switching control signal or the fourth switching control signal to the second switching circuit. In particular, when light-emitting sub-circuits in an initial light-emitting region are connected in series, light is emitted based on the initial light-emitting region; when the light-emitting circuits in the initial light-emitting region are connected in parallel (e.g., the light-emitting circuits 511 and 512 shown in FIG. 5 are connected in parallel), the initial light-emitting region is divided into a plurality of final light-emitting regions, which is equivalent to the step S141.

It should be noted that, in some embodiments, when the initial light-emitting region is divided into a plurality of final light-emitting regions, the brightness of the plurality of final light-emitting regions can be controlled individually. For example, the light-emitting sub-circuits 511 to 514 in FIG.

5 are controlled by their respective control signals, which are used to regulate the current flowing through the light-emitting sub-circuits, thereby adjusting the brightness of the light-emitting sub-circuits. When the light-emitting sub-circuits (e.g., 511 and 512, or, 513 and 514) in an initial light-emitting region are connected in parallel, each light-emitting sub-circuit can be equivalent to a final light-emitting region because the brightness of the light-emitting sub-circuit can be independently controlled by the corresponding control signal.

In the present disclosure, both the third switching control signal and the fourth switching control signal are generated by the backlight partition sub-circuit 440.

In the embodiment shown in FIG. 5, the second switching circuit is implemented by a relay. The working principle of the second switching circuit will be explained below by taking the second switching circuit 531 as an example.

The second switching circuit 531 is equivalent to a double-pole double-throw switch. In the embodiment shown in FIG. 5, the second switching circuit 531 includes a control terminal C1, six contact terminals (a contact terminal 11, a contact terminal 12, a contact terminal 13, a contact terminal 14, a contact terminal 15 and a contact terminal 16) and a pair of conductive contact sheets. The contact terminal 11 and the contact terminal 12 are electrically connected to each other, the contact terminal 13 and the contact terminal 14 are disconnected from each other, and an end of one of the conductive contact sheets is electrically hinged with the contact terminal 15, and an end of the other of the conductive contact sheets is electrically hinged with the contact terminal 16.

When the third switching control signal is received by the control terminal of the second switching circuit 531, the second switching circuit 531 is in a normal closed state. The two conductive contact sheets of the second switching circuit 531 are at the contact terminals 11 and 12, respectively. A positive electrode for a voltage at the input terminal 550 is electrically coupled to a second terminal of the light-emitting sub-circuit 511. A first terminal of the light-emitting sub-circuit 512 is electrically coupled to a first terminal of the light-emitting sub-circuit 511 via the contact terminal 15 and the contact terminal 16, and the second terminal of the light-emitting sub-circuit 512 can be electrically coupled to a negative electrode for the voltage at the input terminal 550 under the control of the first switching circuit 540, thus realizing the series connection between the light-emitting sub-circuit 511 and the light-emitting sub-circuit 512.

When a fourth switching control signal is received by the control terminal of the second switching circuit 531, the second switching circuit 531 is in a normal open state, and the conductive contact sheets are located at the contact terminal 13 and the contact terminal 14, respectively. At this time, the positive electrode for the voltage at the input terminal 550 supplies power to the light-emitting sub-circuit 511 (for example, the positive electrode for the voltage at the input terminal 550 is electrically coupled to the second terminal of the light-emitting sub-circuit 511), and at the same time, via the contact terminal 14 and the contact terminal 16, the positive electrode for the voltage at the input terminal 550 supplies power to the light-emitting sub-circuit 512 (for example, the positive electrode for the voltage at the input terminal 550 is electrically coupled to the first terminal of the light-emitting sub-circuit 512). The first terminal of the light-emitting sub-circuit 511 is electrically coupled to the negative electrode for the voltage at the input terminal 550 via the contact terminal 15 and the contact terminal 13. The second terminal of the light-emitting sub-circuit 512 may be electrically coupled to the negative electrode for the voltage at the input terminal 550 directly. Thus, the light-emitting sub-circuit 511 and the light-emitting sub-circuit 512 are connected in parallel.

As shown in FIG. 5, the second switching circuit 532 includes a control terminal C3, six contact terminals (i.e. a contact terminal 31, a contact terminal 32, a contact terminal 33, a contact terminal 34, a contact terminal 35 and a contact terminal 36) and a pair of conductive contact sheets. The contact terminal 31 and the contact terminal 32 are electrically coupled to each other, the contact terminal 33 and the contact terminal 34 are disconnected from each other, and an end of one of the conductive contact sheets is electrically hinged with the contact terminal 35, and an end of the other of the conductive contact sheets is electrically hinged with the contact terminal 36.

The working principle of the second switching circuit 532 is similar to that of the second switching circuit 531, and thus will not be repeated herein.

In the present disclosure, there is no special limit on the specific structure of the first switching circuit 540. In the embodiment shown in FIG. 5, the first switching circuit 540 includes a first switching sub-circuit 541 and a second switching sub-circuit 542.

As shown in FIG. 5, the first switching sub-circuit 541 is connected in series between two adjacent input terminals 550.

As shown in FIG. 5, the second switching sub-circuit 542 is arranged between two adjacent initial light-emitting regions. In particular, a control terminal of the second switching sub-circuit 542 is electrically coupled to a control terminal of the first switching sub-circuit 540. When the first switching control signal is received by the control terminal of the second switching sub-circuit 542, the second switching sub-circuit 542 controls the first switching sub-circuit 541 to be closed, and controls the initial light-emitting regions located on both sides of the second switching sub-circuit 542 to be connected in series. When the second switching control signal is received by the control terminal of the second switching sub-circuit 542, the first switching sub-circuit 541 is controlled to be open, and the initial light-emitting regions on both sides of the second switching sub-circuit 542 are controlled to be electrically coupled to the corresponding input terminals, respectively.

In the present disclosure, there is no limit on how the second switching sub-circuit 542 controls the first switching sub-circuit 541. For example, as an embodiment, the first switching sub-circuit 541 may be a triode, and the gate of the first switching sub-circuit is coupled to the control terminal of the second switching sub-circuit 542. When the first switching control signal is received by the control terminal of the second switching sub-circuit 542, the first switching control signal is also received by the gate of the first switching sub-circuit 541, thus making first and second electrodes of the first switching sub-circuit 541 electrically coupled to each other, that is, the first switching sub-circuit 541 is controlled to be turned on. When the second switching control signal is received by the control terminal of the second switching sub-circuit 542, the second switching control signal is also received by the gate of the first switching sub-circuit 541, thus making the first and second electrodes of the first switching sub-circuit 541 to be disconnected from each other, that is, the first switching sub-circuit 541 is controlled to be turned off.

Of course, the present disclosure is not limited thereto, as long as the second switching sub-circuit 542 and the first switching sub-circuit 541 are controlled to be associated with each other.

In the embodiment shown in FIG. 5, the second switching sub-circuit 542 is a relay with a same configuration as that of the second switching circuit 531. In particular, the second switching sub-circuit 542 includes a control terminal C2, six contact terminals (i.e. a contact terminal 21, a contact terminal 22, a contact terminal 23, a contact terminal 24, a contact terminal 25 and a contact terminal 26) and a pair of conductive contact sheets. The contact terminal 21 is electrically coupled to the contact terminal 22, the contact terminal 23 and the contact terminal 24 are disconnected from each other, and an end of one of the conductive contact sheets is electrically hinged with the contact terminal 25, and an end of the other of the conductive contact sheets is electrically hinged with the contact terminal 26.

When receiving the first switching control signal, the second switching sub-circuit 542 is in the normal closed state. One conductive contact sheet will make the contact terminal 25 and the contact terminal 21 be electrically coupled to each other, and the other conductive contact sheet will make the contact terminal 26 and the contact terminal 22 be electrically coupled to each other, leaving the other contact terminals disconnected from each other. Moreover, the first switching sub-circuit 541 is turned on. When the light-emitting sub-circuit 511 and the light-emitting sub-circuit 512 are connected in series, current flows through the light-emitting sub-circuit 511, the light-emitting sub-circuit 512, the light-emitting sub-circuit 513 and the light-emitting sub-circuit 514, and then flows to the negative electrode for the voltage at the input terminal 550 (for example, the input terminal 550 at the right side of FIG. 5) in the initial light-emitting region a2 where the light-emitting sub-circuit 513 and the light-emitting sub-circuit 514 are located.

When receiving the second switching control signal, the first switching sub-circuit 541 is open, the contact terminal 23 is electrically coupled to one terminal of the first switching sub-circuit 541, and the contact terminal 24 is electrically coupled to the other terminal of the first switching sub-circuit 541. The contact terminal 25 is electrically coupled to the contact terminal 23, and the contact terminal 26 is electrically coupled to the contact terminal 24. The two adjacent light-emitting regions a1 and a2 are disconnected from each other and independent of each other.

In the present disclosure, a power supply circuit may be required to supply power to the above input terminals. Optionally, the backlight further includes a power supply circuit including a plurality of output circuits, and the output terminals DC/DC Output of the plurality of output circuits are electrically coupled to the plurality of input terminals 550, respectively.

Figure 6:
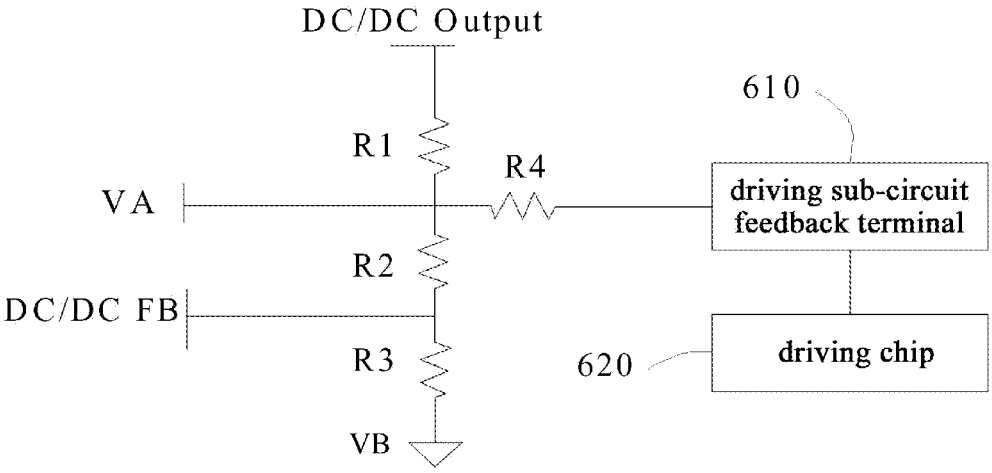
FIG. 6 is a schematic diagram of a power module in the backlight provided by the present disclosure.

FIG. 6 shows an exemplary structure of an output circuit. As shown in FIG. 6, the output circuit includes a driving chip 620, a first reference voltage input terminal VA, a second reference voltage input terminal VB, a DC power feedback terminal DC/DC FB, a driving sub-circuit feedback terminal 610, a first resistor R1, a second resistor R2, a third resistor R3 and a fourth resistor R4.

A first terminal of the first resistor R1 is electrically coupled to the output terminal DC/DC Output, and a second terminal of the first resistor R1 is electrically coupled to the first reference voltage input terminal VA.

A first terminal of the second resistor R2 is electrically coupled to the second terminal of the first resistor R1, and a second terminal of the second resistor R2 is electrically coupled to the DC power feedback terminal DC/DC FB.

A first terminal of the third resistor R3 is electrically coupled to the second terminal of the second resistor R2, and a second terminal of the third resistor R3 is electrically coupled to the second reference voltage input terminal VB.

A first terminal of the fourth resistor R4 is electrically coupled to the second terminal of the first resistor R1, and a second terminal of the fourth resistor R4 is electrically coupled to the driving sub-circuit feedback terminal 610.

The driving chip 620 can output a corresponding feedback voltage to the driving sub-circuit feedback terminal 610 according to a received feedback control signal.

It should be pointed out that, the first resistor R1, the second resistor R2, the third resistor R3 and the fourth resistor R4 each are intended to convert a current to a voltage. The voltage output by the driving sub-circuit feedback terminal 610 is adjustable. For example, as a specific implementation, the voltage may be adjusted between 0.214V and 2.5V.

The current output by the light-emitting sub-circuits in each initial light-emitting region, which are connected in series, to the input terminal 550 is different from the current output by the light-emitting sub-circuits in the initial light-emitting region, which are connected in parallel, to the input terminal 550.

For example, in the embodiment shown in FIG. 5, the voltage input by each input terminal 550 is 1*V. When the light-emitting sub-circuit 511 to the light-emitting sub-circuit 514 are connected in series, the voltage applied to the light-emitting sub-circuit 511 to the light-emitting sub-circuit 514 should be 2*V. When the light-emitting sub-circuit 511 and the light-emitting sub-circuit 512 are connected in parallel, the voltages applied to the light-emitting sub-circuit 511 and the light-emitting sub-circuit 512 should be 1*V, respectively. The output voltage can be controlled by the feedback control signal.

In the present disclosure, there is no limit on each light-emitting sub-circuit. For example, each light-emitting sub-circuit may include a lamp string consisting of a plurality of light-emitting elements connected in series.

As a third aspect of the present disclosure, a display device is provided that includes a display panel, a backlight and a driving circuit for driving the backlight. The backlight includes a plurality of light-emitting elements, and the driving circuit is the driving circuit provided by the present disclosure.

As mentioned above, when the driving circuit is used to drive the backlight to emit light, the partition of the backlight is no longer fixed, but may be determined by the brightness difference of the image to be displayed, which can not only realize the fine display of the image, but also realize the low energy consumption of the backlight.

Optionally, this backlight is the backlight provided by the present disclosure.

It should be understood that, the above embodiments are merely intended to illustrate the principle of the present disclosure, and the present disclosure is not limited thereto. A person skilled in the art can make various variants and improvements without departing from the spirit and essence of the present disclosure, and these variants and improvements should also be regarded as falling into the protection scope of the present disclosure.

The invention claimed is:

1. A driving method for a backlight, for driving the backlight to emit light according to an image to be displayed, wherein the backlight comprises a plurality of initial light-emitting regions, and each of the plurality of initial light-emitting regions comprises multiple light-emitting elements, comprising steps of:

calculating a brightness difference value of the image to be displayed, such that the brightness difference value of the image to be displayed indicates a difference among brightness of all parts of the image to be displayed;

determining whether the brightness difference value of the image to be displayed is greater than a predetermined difference value of the image; and when the brightness difference value of the image to be displayed is greater than the predetermined difference value of the image:

dividing the image to be displayed into a plurality of sub-regions such that the plurality of sub-regions are in one-to-one correspondence with the plurality of initial light-emitting regions;

partitioning the backlight according to brightness difference values of the plurality of sub-regions to obtain a plurality of final light-emitting regions of the backlight, such that each of the plurality of sub-regions corresponds to at least one of the plurality of final light-emitting regions, and the number of final light-emitting regions corresponding to each of the plurality of sub-regions is positively correlated with the brightness difference value of the sub-region, and the brightness difference value of the sub-region indicates a difference among brightness of a plurality of parts of the sub-region; and driving the backlight to emit light according to the plurality of final light-emitting regions, wherein the step of partitioning the backlight according to brightness difference values of the plurality of sub-regions comprises a step of:

dividing an initial light-emitting region corresponding to a sub-region into a plurality of final light-emitting regions when a brightness difference value of the sub-region exceeds a first predetermined difference value.

2. The driving method of claim 1, further comprising a step of:

driving the backlight to emit light according to the plurality of initial light-emitting regions when it is determined that the brightness difference value of the image to be displayed is not greater than the predetermined difference value of the image.

3. The driving method of claim 1, wherein the step of partitioning the backlight according to brightness difference values of the plurality of sub-regions comprises a step of:

merging initial light-emitting regions corresponding to two adjacent sub-regions to obtain a final light-emitting region when a brightness difference between the two adjacent sub-regions is less than a second predetermined difference value and the brightness difference value of each of the two adjacent sub-regions is less than the second predetermined difference value, wherein the brightness difference between the two adjacent sub-regions indicates a difference between brightness of the two adjacent sub-regions, and the first predetermined difference value is larger than the second predetermined difference value.

4. The driving method of claim 1, wherein the step of calculating a brightness difference value of the image to be displayed comprises a step of: calculating the brightness difference value of the image to be displayed according to an average brightness value of the image to be displayed, and differences between respective brightness values of all pixel units of the image to be displayed and the average brightness value, and the step of partitioning the backlight according to the brightness difference values of the plurality of sub-regions comprises steps of: calculating the brightness difference value of each sub-region of the plurality of sub-regions according to the average brightness value of the sub-region and the differences between respective brightness values of all pixel units of the sub-region and the average brightness value of the sub-region, and partitioning the backlight according to the respective brightness difference values of the plurality of sub-regions.

5. The driving method of claim 1, wherein the image to be displayed is divided into a plurality of sub-images, and the step of calculating a brightness difference value of the image to be displayed comprises a step of: calculating the brightness difference value of the image to be displayed according to a plurality of average brightness values of the plurality of sub-images of the image to be displayed, and a largest average brightness value and a smallest average brightness value among the plurality of average brightness values, and each sub-region of the plurality of sub-regions is divided into a plurality of regional sub-images, and the step of partitioning the backlight according to brightness difference values of the plurality of sub-regions comprises steps of: calculating the brightness difference value of the sub-region according to a plurality of average brightness values of the plurality of regional sub-images of the sub-region, and a largest average brightness value and a smallest average brightness value among the plurality of average brightness values, and partitioning the backlight according to the respective brightness difference values of the plurality of sub-regions.

6. A backlight, comprising a plurality of light-emitting elements a driving circuit and a control signal receiving terminal, wherein the backlight comprises a plurality of initial light-emitting regions, and each of the plurality of initial light-emitting regions comprises a part of the plurality of light-emitting elements, the driving circuit comprises:

a brightness difference calculation sub-circuit, which is configured to calculate a brightness difference value of an image to be displayed, and the brightness difference value of the image to be displayed represents a brightness difference among all parts of the image to be displayed;

a comparison sub-circuit, which is configured to compare the brightness difference value of the image to be displayed with a predetermined difference value of the image to generate a comparison result;

an image partition sub-circuit, which is configured to divide the image to be displayed into a plurality of sub-regions such that the plurality of sub-regions are in one-to-one correspondence with the plurality of initial light-emitting regions, on the condition that the brightness difference value of the image to be displayed is greater than the predetermined difference value of the image;

a backlight partition sub-circuit, which is configured to partition the backlight according to brightness difference values of the plurality of sub-regions to obtain a plurality of final light-emitting regions, such that the number of the plurality of final light-emitting regions corresponding to each sub-region is positively correlated to the brightness difference value of the sub-region; and a driving sub-circuit, which is configured to generate a partition control signal according to positions of the plurality of final light-emitting regions generated by the backlight partition sub-circuit and send the partition control signal to the backlight to drive the backlight to emit light according to the plurality of final light-emitting regions, wherein the control signal receiving terminal is electrically coupled to the driving sub-circuit, wherein the plurality of light-emitting elements of the backlight form a plurality of final light-emitting regions according to the partition control signal, wherein the backlight comprises a plurality of input terminals and a plurality of first switching circuits, and the partition control signal comprises a first switching control signal and a second switching control signal;

each initial light-emitting region of the plurality of initial light-emitting regions comprises two or more light-emitting elements of the plurality of light-emitting elements, and corresponds to an input terminal of the plurality of input terminals, which supplies power to the two or more light-emitting elements in the initial light-emitting region, and a first switching circuit of the plurality of first switching circuits is provided between two adjacent initial light-emitting regions of the plurality of initial light-emitting regions; and the first switching circuit comprises a control terminal electrically coupled to the control signal receiving terminal, and is configured to cause the two adjacent initial light-emitting regions to be connected in series on the condition that the first switching control signal is received by the control terminal of the first switching circuit, and cause the two adjacent initial light-emitting regions to be disconnected from each other on the condition that the second switching control signal is received by the control terminal of the first switching circuit, wherein the backlight further comprises a plurality of second switching circuits, wherein the partition control signal comprises a third switching control signal and a fourth switching control signal;

each of the initial light-emitting regions comprises a plurality of light-emitting circuits, each of which comprises at least one light-emitting element, and a second switching circuit of the plurality of second switching circuits is arranged between two adjacent light-emitting circuits in a same initial light-emitting region; and the second switching circuit comprises a control terminal electrically coupled to the control signal receiving terminal, and the second switching circuit is configured to cause the two adjacent light-emitting circuits to be connected in series on the condition that the third switching control signal is received by the control terminal of the second switching circuit, and cause the two adjacent light-emitting circuits to be connected in parallel on the condition that the fourth switching control signal is received by the control terminal of the second switching circuit.

7. The backlight of claim 6, wherein the first switching circuit comprises a first switching sub-circuit and a second switching sub-circuit;

the first switching sub-circuit is connected in series between two adjacent input terminals of the plurality of input terminals; and the second switching sub-circuit is arranged between two adjacent initial light-emitting regions of the plurality of initial light-emitting regions, and a control terminal of the second switching sub-circuit is electrically coupled to the control terminal of the first switching sub-circuit; on the condition that the first switching control signal is received by the control terminal of the second switching sub-circuit, the second switching sub-circuit controls the first switching sub-circuit to be turned on and controls two initial light-emitting regions located at opposite sides of the second switching sub-circuit to be connected in series, and on the condition that the second switching control signal is received by the control terminal of the second switching sub-circuit, the second switching sub-circuit controls the first switching sub-circuit to be turned off and controls the two initial light-emitting regions located at the opposite sides of the second switching sub-circuit to be electrically coupled to the corresponding input terminals, respectively.

8. The backlight of claim 6, further comprising a power supply circuit, which comprises a plurality of output circuits, a plurality of output terminals of the plurality of output circuits are electrically coupled to the plurality of input terminals, respectively, each output circuit of the plurality of output circuits comprises a driving chip, a first reference voltage input terminal, a second reference voltage input terminal, a DC power feedback terminal, a driving sub-circuit feedback terminal, a first resistor, a second resistor, a third resistor and a fourth resistor, a first terminal of the first resistor is electrically coupled to the output terminal, and a second terminal of the first resistor is electrically coupled to the first reference voltage input terminal;

a first terminal of the second resistor is electrically coupled to the second terminal of the first resistor, and a second terminal of the second resistor is electrically coupled to the DC power feedback terminal;

a first terminal of the third resistor is electrically coupled to the second terminal of the second resistor, and a second terminal of the third resistor is electrically coupled to the second reference voltage input terminal;

a first terminal of the fourth resistor is electrically coupled to the second terminal of the first resistor, and a second terminal of the fourth resistor is electrically coupled to the driving sub-circuit feedback terminal; and the driving chip outputs a corresponding feedback voltage to the driving sub-circuit feedback terminal based on a received feedback control signal.

9. A display device, comprising a display panel, and a backlight, wherein the backlight is the backlight of claim 6.

* * * * *